United States Patent [19]

Ooka et al.

[11] 4,170,115

[45] Oct. 9, 1979

[54] APPARATUS AND PROCESS FOR VAPORIZING LIQUEFIED NATURAL GAS

[75] Inventors: Isami Ooka; Tomohiro Sato; Kyohei Niwa, all of Osaka, Japan

[73] Assignee: Osaka Gas Company, Limited, Osaka, Japan

[21] Appl. No.: 813,095

[22] Filed: Jul. 5, 1977

[30] Foreign Application Priority Data

Jul. 5, 1976 [JP] Japan ..... 51-80259

[51] Int. Cl.[2] ..... F17C 7/02

[52] U.S. Cl. ..... 62/52; 122/33

[58] Field of Search ..... 62/52, 53; 122/33; 126/360 A

[56] References Cited

U.S. PATENT DOCUMENTS

| | | | |
|---|---|---|---|
| 3,266,261 | 8/1966 | Anderson | 62/52 |
| 3,269,385 | 8/1966 | Mitchell et al. | 62/52 |
| 3,535,210 | 10/1970 | Linde et al. | 62/52 |
| 3,712,073 | 1/1973 | Arenson | 62/52 |
| 3,720,057 | 3/1973 | Arenson | 62/53 |
| 3,724,229 | 4/1973 | Seliber | 62/52 |
| 3,726,085 | 10/1973 | Arenson | 62/52 |
| 3,986,340 | 10/1976 | Bivins, Jr. | 62/52 |

*Primary Examiner*—Ronald C. Capossela

*Attorney, Agent, or Firm*—Larson, Taylor and Hinds

[57] ABSTRACT

Apparatus for vaporizing liquefied natural gas using estuarine water comprising as arranged in series a heat exchanger of the indirectly heating, intermediate fluid type, a multitubular concurrent heat exchanger and a multitubular countercurrent heat exchanger and process for vaporizing liquefied natural gas using the same.

10 Claims, 1 Drawing Figure

APPARATUS AND PROCESS FOR VAPORIZING LIQUEFIED NATURAL GAS

Figure 1:
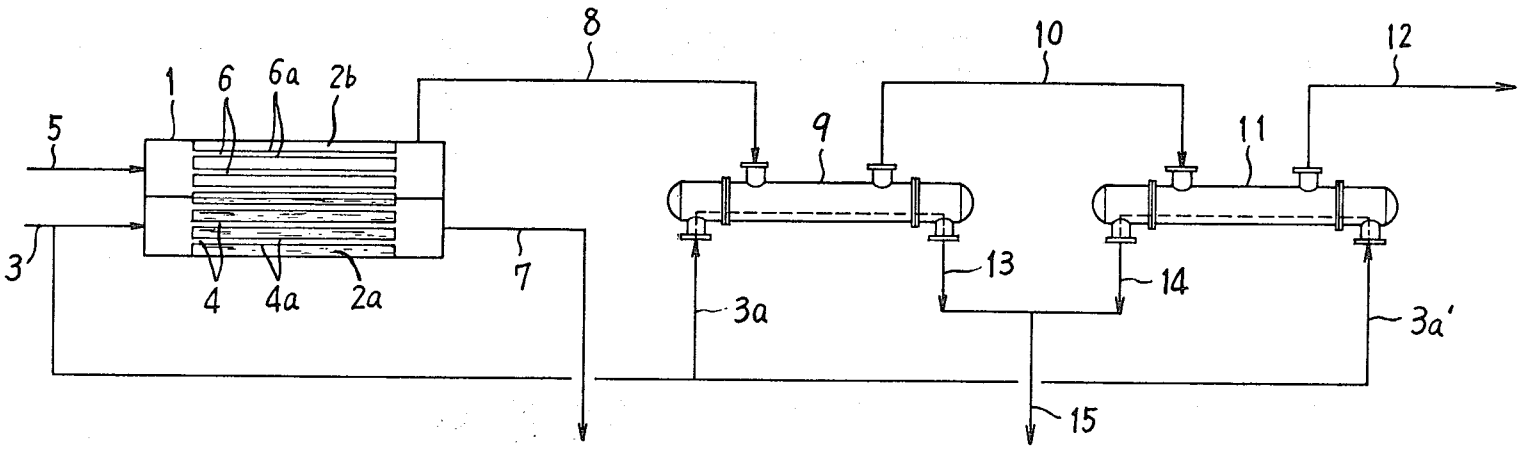

This invention relates to an apparatus and process for vaporizing liquefied natural gas, and more particularly to an apparatus and process for vaporizing liquefied natural gas to natural gas heated to a temperature suitable for use, for example to a temperature of about 0° to about 25° C.

As is well known, liquefied natural gas has a low temperature of about −160° C. Accordingly, hot water or steam, when used to heat the liquefied gas for vaporization, freezes, giving rise to the hazard of clogging up the evaporator. Various improvements have therefore been made. The evaporators presently used are mainly of the open rack type, intermediate fluid type and submerged combustion type.

Open rack type evaporators use seawater as a heat source for countercurrent heat exchange with liquefied natural gas. Evaporators of this type are free of clogging due to freezing, easy to operate and to maintain and are accordingly widely used. However, they inevitably involve icing up on the surface of the lower portion of the heat transfer tube, consequently producing increased resistance to heat transfer, so that the evaporator must be designed to have an increased heat transfer area, namely a greater capacity, which entails a higher equipment cost. To ensure improved heat efficiency, evaporators of this type include an aluminum heat transfer tube of special configuration. This renders the evaporators economically further disadvantageous.

Instead of vaporizing liquefied natural gas by direct heating with hot water or steam, evaporators of the intermediate fluid type use propane, Freon or like refrigerant having a low melting point, such that the refrigerant is heated with hot water or steam first to utilize the evaporation and condensation of the refrigerant for the vaporization of liquefied natural gas. Evaporators of this type are less expensive to build than those of the open rack type but require heating means such as a burner for the preparation of hot water or steam and are therefore costly to operate owing to the fuel consumption.

Evaporators of the submerged combustion type comprise a tube immersed in water which is heated with a combustion gas injected thereinto from a burner to heat with the water the liquefied natural gas passing through the tube. Like the intermediate fluid type, evaporators of the third type involve a fuel cost and is expensive to operate.

The main object of this invention is to provide an apparatus and process for vaporizing liquefied natural gas which utilize water from the sea, river or lake, namely estuarine water, as the heat source without the necessity of using any fuel and which are economical to operate and inexpensive to construct.

Another object of this invention is to provide an efficient apparatus and process for vaporizing liquefied natural gas which utilize estuarine water as the heat source and which are entirely free of clogging due to freezing of the heat source water, the evaporator being capable of producing vaporized natural gas heated to a temperature close to the temperature of the heat source water, for example, to a temperature of 0° to 25° C.

These and other objects of this invention will become apparent from the following description.

The present invention provides an apparatus for vaporizing liquefied natural gas comprising as arranged in series a heat exchanger of the indirectly heating, intermediate fluid type for heating liquefied natural gas with a heating medium to produce vaporized natural gas of a low temperature not higher than the freezing point of estuarine water from the liquefied natural gas, the heating medium being a refrigerant vaporized by being heated with estuarine water as a heat source and having a temperature not higher than the freezing point of the estuarine water, a multitubular concurrent heat exchanger for bringing the low-temperature vaporized natural gas from the heat exchanger into concurrent contact with estuarine water serving as a heat source to heat the vaporized natural gas, and a multitubular countercurrent heat exchanger for bringing the heated natural gas from the concurrent heat exchanger into countercurrent contact with estuarine water serving as a heat source to heat the natural gas to a temperature close to the temperature of the estuarine water.

According to this invention, the heat exchanger of the indirectly heating, intermediate fluid type contains a refrigerant as enclosed therein. The refrigerant enclosed in the exchanger is divided into a lower liquid portion and an upper vapor portion.

Examples of useful refrigerants are those already known, among which inexpensive refrigerants having the lowest possible freezing point are preferable to use. More specific examples are propane (freezing point: −189.9° C., boiling point: −42.1° C.), fluorinated hydrocarbon known as "Freon-12" ($CCl_2F_2$, freezing point: −157.8° C., boiling point: −29.8° C.) and ammonia (freezing point: −77.7° C., boiling point: −33.3° C.).

The refrigerant within the exchanger is used usually at increased pressure which, although variable with the operating conditions, is generally in the range of 0 to 5 kg/cm$^2$. The pressures in this specification are expressed all in terms of gauge pressure.

The lower portion of the heat exchanger where the liquid refrigerant portion is present is provided with passages for estuarine water serving as the heat source. The lower liquid refrigerant portion is indirectly heated with the estuarine water flowing through the passages and flows into the upper vapor portion on vaporization. On the other hand, the upper vapor refrigerant portion is used for heating liquefied natural gas through heat exchange, whereupon the vapor condenses. The condensed refrigerant returns to the lower liquid portion. In this way, the refrigerant undergoes vaporization and condensation repeatedly.

Since the refrigerant thus has a temperature of not higher than the freezing point, there is the likelihood that when effecting heat exchange between the estuarine water and the refrigerant, the estuarine water will freeze within the passages, but this problem can be readily overcome by increasing the velocity of the flow of the water through the passages. However, the flow velocity is limited from the viewpoint of economy, so that it should be avoided to reduce the temperature of the refrigerant to an exceedingly low level. Usually, the temperature of the refrigerant is not lower than −10° C. (at 2.5 kg/cm$^2$) for propane and not lower than −15° C. (at 0.9 kg/cm$^2$) for Freon-12 when the estuarine water has a temperature of 6° C. and a flow velocity of 2 m/sec. The heating of the refrigerant with the estuarine water to a temperature not higher than the freezing point of the water makes it possible to use a smaller heat transfer area than the heating of the refrigerant with the water to a temperature not lower than the freezing point of the water.

The upper portion of the heat exchanger accommodating the vapor refrigerant is provided with passages for the liquefied natural gas. The liquefied natural gas flowing through the passages is heated with the vapor refrigerant and vaporized during its passage therethrough. The liquefied natural gas is admitted to the passages usually at elevated pressure which is generally 5 to 100 kg/cm$^2$ although widely variable.

Since the heat exchanger is followed by other heat exchangers serving as after heaters, the objects of this invention can be fully achieved insofar as the liquefied natural gas is almost vaporized by the intermediate fluid type exchanger although the vaporized gas obtained has a low temperature. For example, when the liquefied natural gas is fed to the exchanger at pressure of 10 to 70 kg/cm$^2$, the vaporized natural gas egressing from the exchanger has a temperature of about −30° to about −50° C. Accordingly, the operation can be carried out with a smaller heat transfer area between liquefied natural gas and refrigerant than when one heat exchanger vaporizes liquefied natural gas and heats the vaporized gas to a temperature of 0° to 25° C. at the same time.

According to this invention, the area of heat transfer between the estuarine water and the refrigerant as well as the area of heat transfer between the refrigerant and the liquefied natural gas can be reduced, with the result that the intermediate fluid type exchanger can be made compact.

According to this invention, a multitubular concurrent heat exchanger is arranged in series with the heat exchanger described above. The vaporized natural gas having a low temperature (−30° to −50° C.) and run off from the heat exchanger of the intermediate fluid type is introduced into the multitubular heat exchanger, in which the gas is brought into concurrent contact with estuarine water and is thereby heated. When the vaporized natural gas of low temperature is brought into countercurrent contact with the estuarine water in a heat exchanger without being thrown into concurrent contact with the water in another heat exchanger, the estuarine water freezes at the portion of lower temperature in the exchanger, thereby resulting in a poor heat transfer. As is the case with this invention, when the contact between the gas and the water is effected by a combination of concurrent- and countercurrent-contact processes, an efficient heat transfer is obtained by the concurrent-contact process because the water does not freeze although the temperature of the gas is not much elevated. Further after the temperature of the gas has been increased by the concurrent-contact process, the gas is brought into countercurrent contact with the water, whereby an efficient heat exchange is obtained.

According to this invention, a multitubular heat exchanger of the countercurrent type is connected in series with the heat exchanger of the concurrent type. The vaporized natural gas heated in the concurrent heat exchanger is fed to the countercurrent heat exchanger, in which the gas is brought into countercurrent contact with estuarine water for efficient heat exchange and is thereby heated to a temperature close to the temperature of the estuarine water. Since the vaporized natural gas has been preheated in the concurrent heat exchanger, the countercurrent contact can be effected also free of any freezing of the estuarine water.

The estuarine water useful as the heat source in this invention has an ambient temperature for example of about 3° to 30° C. The estuarine water is admitted to the heat exchangers at a sufficiently high velocity for example of about 1.5 m/sec to about 3.0 m/sec in order to avoid freezing.

In the present invention, known multitubular heat exchangers are used as the concurrent and countercurrent heat exchangers.

As already described, the heat transfer between the estuarine water and the refrigerant and the heat transfer between the refrigerant and the liquefied natural gas can be carried out over a reduced area within the intermediate fluid type heat exchanger of this invention, so that the heat exchanger can be built very compact. Additionally, usual multitubular heat exchangers which are inexpensively available are usable as arranged in series with this heat exchanger. Consequently, the overall evaporator can be constructed at a greatly reduced cost. The evaporator is further inexpensive to operate because estuarine water is used as the heat source. Because the low-temperature vaporized natural gas is heated first by concurrent contact with the water and then by countercurrent contact therewith, the refrigerant and the vaporized natural gas, despite their temperatures not higher than the freezing point of the estuarine water, will not freeze the water, with the result that the vaporized natural gas can be heated to a temperature, e.g. 0° to 25° C., close to the temperature of the estuarine water.

The features of this invention will be described below with reference to an embodiment of the invention with reference to the drawing.

FIG. 1 is a flow chart illustrating the embodiment.

A refrigerant such as propane or Freon-12 is enclosed in a heat exchanger 1 of the intermediate fluid type. The refrigerant in the exchanger is in the form of a liquid in the lower portion 2*a* of the exchanger 1 and in the form of a vapor in its upper portion 2*b*. The lower portion of the exchanger 1 is provided with passages 4 for passing estuarine water supplied from a main duct 3, while the upper portion 2*b* of the exchanger is provided with passages 6 for passing liquefied natural gas supplied from a conduit 5.

The liquid refrigerant in the lower portion 2*a* in the heat exchanger 1 is subjected to heat exchange with the estuarine water flowing through the passages 4 through partition walls 4*a* providing heat transfer surfaces and flows into the upper portion 2*b* on vaporization. On the other hand, the vapor refrigerant in the upper portion 2*a* is subjected to heat exchange with the liquefied natural gas flowing through the passages 6 in the portion 2*b* through partition walls 6*a* providing heat transfer surfaces, whereupon the vapor refrigerant condenses. The condensate returns to the lower portion 2*a*. In this way, the refrigerant undergoes vaporization and condensation repeatedly within the heat exchanger 1. The water used as the heat source is run off from the system through a drain pipe 7.

The liquefied natural gas vaporized by being heated with the heated refrigerant serving as a heat medium flows through a conduit 8 into a heat exchanger 9 of the concurrent type, within which the vaporized natural gas comes into concurrent contact with the estuarine water admitted to the exchanger 9 from a branch duct 3*a* and is thereby heated. The heated natural gas further flows into a heat exchanger 11 of the countercurrent type through a conduit 10. The gas introduced into the exchanger 11 comes into countercurrent contact with the estuarine water fed to the exchanger 11 via a branch duct *3a'* and is finally heated to a temperature close to the temperature of the estuarine water. The natural gas is run off from a conduit 12 and sent to the customer. The estuarine water drawn off from the concurrent and countercurrent heat exchangers is discharged from the system via drain pipes 13, 14 and 15.

EXAMPLES 1 TO 5

Liquefied natural gas (LNG) is vaporized by an apparatus of this invention as schematically shown in FIG. 1. The results are listed in Table 1 below. Heat transfer area Lower portion of exchanger 1: 382.3 $m^2$
Upper portion of exchanger 1: 172 $m^2$
Exchanger 9: 86.9 $m^2$
Exchanger 11: 86.9 $m^2$ Table 1

| Example | 1 | 2 | 3 | 4 | 5 |
|---|---|---|---|---|---|
| LNG flow rate (tons/hr.) | 40 | 60 | 40 | 40 | 60 |
| LNG pressure ($Kg/cm^2$ G) | 50 | 50 | 10 | 50 | 10 |
| Temp. of LNG at inlet (°C.) | −150 | −150 | −150 | −150 | −150 |
| Temp. of LNG at outlet of exchanger 1 (°C.) | −34 | −44 | −37 | −41 | −57 |
| Temp. of LNG at outlet of exchanger 9 (°C.) | −1 | 1.1 | −1 | −2.9 | −4 |
| Temp. of LNG at outlet of exchanger 11 (°C.) | 4.5 | 12.5 | 4.0 | 3.7 | 11.5 |
| Intermediate heat medium | Propane | Propane | Propane | Freon-12 | Freon-12 |
| Temp. of medium (°C.) | −7.7 | −1.6 | −8.5 | −12 | −7 |
| Pressure of medium ($Kg/cm^2$ G) | 2.6 | 3.5 | 2.5 | 1.05 | 1.5 |
| Temp. of estuarine water (°C.) | 6 | 15 | 6 | 6 | 15 |
| Flow exchanger rate of estuarine water ($m^3$/hr.) | | | | | |
| First heat exchanger (1) | 1520 | 1520 | 1520 | 1520 | 1520 |
| Second heat exchanger (9) | 240 | 240 | 240 | 240 | 240 |
| Third heat exchanger (11) | 240 | 240 | 240 | 240 | 240 |

What we claim is:

1. Apparatus for vaporizing liquefied natural gas and heating the vaporized gas close to the temperature of estuarine water used as the heat source comprising:

(i) a heat exchanger of the indirect heating type having enclosed therein an intermediate heating medium divided into a lower liquid portion and an upper vapor portion for producing vaporized natural gas of a low temperature not higher than the freezing point of estuarine water from the liquefied natural gas, an inlet for introducing estuarine water into said lower liquid portion for indirect heat exchange with said intermediate heating medium, an outlet for discharging estuarine water from said lower liquid portion after said indirect heat exchange with said intermediate heating medium, said intermediate heating medium being heated to a vaporization temperature which is not higher than the freezing point of said estuarine water by said indirect heat exchange therewith in said lower liquid portion, the vaporized intermediate heating medium passing to said upper vapor portion, an inlet for introducing liquid natural gas into said upper vapor portion for indirect heat exchange with the vaporized intermediate heat exchange medium to vaporize said liquid natural gas, and an outlet for discharge of vaporized liquid natural gas, (ii) a multitubular concurrent heat exchanger for heating the vaporized gas from the first heat exchanger by heat exchange between the gas and estuarine water, the concurrent heat exchanger having an inlet and an outlet for the gas and an inlet and a discharge outlet for estuarine water, and the gas inlet being in fluid communication with the gas outlet of the first heat exchanger, and (iii) a multitubular countercurrent heat exchanger for heating the vaporized natural gas from the second heat exchanger close to the temperature of estuarine water by heat exchange between the gas and estuarine water, the countercurrent heat exchanger having an inlet and an outlet for the gas and an inlet and a discharge outlet for estuarine water, and the gas inlet being in fluid communication with the gas outlet of the second heat exchanger.

2. Apparatus as defined in claim 1 wherein the intermediate heat exchange medium comprises propane, Freon-12 or ammonia.

3. Apparatus as defined in claim 2 wherein the intermediate heat exchange medium comprises propane which is maintained at a temperature not lower than −10° C. (2 $Kg/cm^2$) within the heat exchanger of the intermediate fluid type.

4. Apparatus as defined in claim 2 wherein the intermediate heat exchange medium comprises Freon-12 which is maintained at a temperature not lower than −15° C. (0.9 $Kg/cm^2$) within the heat exchanger of the intermediate fluid type.

5. Apparatus as defined in claim 1 wherein the vaporized natural gas produced in the heat exchanger of the intermediate fluid type has a temperature of −30° to −50° C. (10 to 70 $Kg/cm^2$).

6. A process for vaporizing liquefied natural gas and heating the vaporized gas close to the temperature of estuarine water used as the heat source comprising the steps of:

(i) heating a liquefied refrigerant in indirect heat exchange with estuarine water to a temperature not higher than the freezing point of the estuarine water to produce vaporized refrigerant, the flow velocity of estuarine water being at a value preventing its freezing, (ii) heating liquefied natural gas in indirect heat exchange with the vaporized refrigerant to produce vaporized natural gas having a temperature not higher than the freezing point of estuarine water and to liquefy the refrigerant, the liquefied refrigerant being returned to step (i), (iii) heating the low-temperature vaporized natural gas from step (i) in concurrent indirect heat exchange with estuarine water, and (iv) heating the vaporized natural gas from step (iii) in countercurrent indirect heat exchange with estuarine water to a temperature close to that of the estuarine water.

7. A process as defined in claim 6 wherein the refrigerant comprises propane, Freon-12 or ammonia.

8. A process as defined in claim 7 wherein the refrigerant comprises propane which is maintained at a temperature not lower than −10° C. (2 Kg/cm$^2$) within the heat exchanger of the intermediate fluid type.

9. A process as defined in claim 7 wherein the refrigerant comprises Freon-12 which is maintained at a temperature not lower than −15° C. (0.9 Kg/cm$^2$) within the heat exchanger of the intermediate fluid type.

10. A process as defined claim 6 wherein the liquefied natural gas is heated with the refrigerant to produce vaporized natural gas having a low temperature of −30° to −50° C. (10 to 70 Kg/cm$^2$).

* * * * *